United States Patent [19]

Boulanger

[11] Patent Number: 4,998,087

[45] Date of Patent: Mar. 5, 1991

[54] PRESSURE OR TEMPERATURE RESPONSIVE SWITCH HAVING TEMPERATURE GRADIENT BETWEEN SENSOR AND ELECTRICAL OUTPUT

[75] Inventor: Henry J. Boulanger, Nicholasville, Ky.

[73] Assignee: Texas Instruments Incorporated, Dallas, Tex.

[21] Appl. No.: 391,255

[22] Filed: Aug. 9, 1989

[51] Int. Cl.[5] ..... H01H 37/52; H01H 35/40

[52] U.S. Cl. ..... 337/354; 200/83 J; 337/380

[58] Field of Search ..... 337/354, 380; 200/83 j

[56] References Cited

U.S. PATENT DOCUMENTS 4,356,365 10/1982 Siiberg ..... 200/83 J

*Primary Examiner*—Harold Broome

*Attorney, Agent, or Firm*—James P. McAndrews; John A. Haug; Melvin Sharp

[57] ABSTRACT

A pressure or temperature responsive switch wherein the high temperature environment at the measuring portion of the switch is thermally isolated from other portions of the switch which are incapable of operation at such high temperatures, thereby providing a relatively low cost switch with the desired capability. There is also provided a pressure or temperature responsive switch as noted above which is assembled by friction fit among the parts and without rivets or the like. Furthermore, the materials used permit waterproof sealing by the use of shrink tubing which bonds to the wire insulation.

31 Claims, 3 Drawing Sheets

PRESSURE OR TEMPERATURE RESPONSIVE SWITCH HAVING TEMPERATURE GRADIENT BETWEEN SENSOR AND ELECTRICAL OUTPUT

BACKGROUND OF THE INVENTION

1. Field of the Invention

This invention relates to a pressure or temperature responsive device and, more specifically, to a novel pressure or temperature responsive switch system also having a defined temperature gradient between the pressure or temperature sensor and the electrical output leads.

2. Brief Description of the Prior Art

Pressure and temperature responsive switches generally are provided with a pressure or temperature responsive element which will open or close a switch when a predetermined minimum pressure or temperature is sensed by the responsive element. Examples of such temperature responsive switches are found are found in the patents of Boulanger (U.S. Pat. No. 4,641,121) for water proof construction and Boulanger (U.S. Pat. No. 4,349,806). Further examples are found in U.S. Pat. Nos. 4,296,287 and 4,638,721 for pressure switches.

A problem which often exists in the environment of such switches is that they are to be mounted on a high temperature device, such as high temperature piping. This high temperature often exceeds the temperature rating of some of the components of many such switches, such as, for example, standard wire insulation and polymeric seals. For this reason, many water proof pressure and temperature responsive switches of the prior art could not be operated on high temperature equipment or could be so used only with the use of relatively complex and expensive parts and materials. It is therefore apparent that a temperature or pressure responsive switch which can be used on such high temperature equipment in moderate temperature environments and which can be produced from relatively inexpensive parts and materials would provide a substantial advance in the art.

SUMMARY OF THE INVENTION

In accordance with the present invention, there is provided a pressure or temperature responsive switch wherein the high temperature mounting surface at the measuring portion of the switch is thermally distant from the wire insulation and seal which are incapable of operation at such high temperatures, allowing conventional cooling along the length of the switch as in a fin and thereby providing a relatively low cost switch with the desired capability. There is also provided in accordance with the present invention a base assembly construction which allows parts to be assembled by pressing and clamping the parts together between the base and the pin guide, thereby eliminating rivets and riveting. In addition, there is provided a pin guide which snaps in place (friction fit) and allows the assembled parts to be moved about during fabrication without need for great care in handling. Still further, there is provided a waterproof construction without the use of epoxy which utilizes a technique to isolate the low temperature vinyl wire insulation and waterproof seal from the high temperature of the sensing end of the transducer. Also, there is provided a waterproof construction which can accommodate crosslinked polyethylene wire insulation and the like at temperatures above those allowed by UL and analogous agencies for epoxy seals. In one embodiment the waterproof seal is not in direct contact with and does not support current carrying parts.

Briefly, in accordance with the present invention, there is provided, for use in an environment at or below the maximum approved use temperature for the wire insulation, a pressure or temperature responsive switch of the above described type wherein the temperature gradient between the pressure or temperature sensing element and the low temperature handling capability output wiring insulation is sufficient to permit the wiring to be operated within its temperature rating. This is accomplished by providing serially contiguous switch elements between the high temperature measuring portion of the switch and the output of low temperature handling capability which are of relatively low heat conductive material.

The switch includes a parameter measuring portion responsive to pressure or temperature, as desired, the example having a snap acting disc therein of well known type which snaps from a first stable position to a second position when a predetermined temperature or pressure is applied thereto. Disposed above the disc is an annular base member capable of withstanding high temperature of up to about 150 degrees C., preferably formed of thermoplastic polyester, preferably polybutylene terephthalate (PBT) having a groove for receiving an O-ring therein contacting the base member and the parameter measuring portion above the disc. A pair of electrical terminals extends through a top wall of the base member and is secured in the base member at said top wall. A resilient electrically conductive member is secured to one of the terminals at one end thereof the other end having a movable electrical contact thereon. Said other terminal is connected to a fixed contact which is either normally in contact or normally out of contact with the movable contact as will be explained hereinbelow.

Within the base member and clamped thereto is a pin guide having a central aperture for guiding a transfer pin therein. The pin guide is also formed of a material capable of withstanding high temperatures of up to about 150 degrees C. and can also be formed of PBT. The transfer pin extends through the aperture in the pin guide and abuts the central or movable portion of the disc at one end thereof. The other end of the transfer pin is normally disposed beneath and out of contact with the resilient electrically conductive member and moves the resilient member upon snapping of the disc. A transition sleeve (not found in the quick connect version) capable of withstanding moderately high temperatures of up to about 125 degrees C., preferably formed of a polycarbonate, is disposed over the base member with an O-ring disposed in a groove therein which mates with a groove in the base member.

The transition sleeve includes a groove at the upper portion thereof for receiving a section of tubing. The tubing is adhesively secured in the groove, preferably with a cyanoacrylate adhesive, and is preferably formed of a material compatible with bonding to the wire insulation. The tubing is preferably formed of a thermoplastic, preferably polyvinylchloride (PVC), though other materials can be used. Electrical conductors with insulation thereon formed of a material capable of withstanding relatively low temperatures of up to about 105 degrees C. are connected to the terminals and extend through the tubing. The insulation is formed of a thermoplastic material, preferably of polyvinylchloride (PVC).

The parameter measuring portion, base member with pin guide and pin therein and transition sleeve are initially disposed in a cylindrical retention cup formed of metal, preferably a steel alloy, having a vertically extending sidewall, the sidewall being rolled under the parameter measuring portion, crimped or rolled into an exterior indentation in the base member and crimped or rolled into an exterior indentation in the transition sleeve to secure the parts together in tight clamped engagement.

The tubing is preferably bondable to the wire insulation, accordingly, by heating the vinyl tubing and vinyl wire insulation and forcing them together, a waterproof seal is formed between the wire insulation and the tubing.

The above described switch is provided in a normally open or normally closed embodiment. In the normally open embodiment, the resilient conductor and contact thereon is normally out of contact with the fixed contact and is moved to contact the fixed contact by the movement of the transfer pin in response to snapping of the disc from a concave upward to a concave downward condition. In the normally closed embodiment, the resilient conductor and contact thereon is normally in contact with the fixed contact and is moved out of contact with the fixed contact by the movement of the transfer pin in response to snapping of the disc as discussed above.

A quick connect embodiment of each of the above described embodiment is provided by eliminating the transition sleeve and tubing and providing terminals extending out of the switch and capable of connection to a mating device.

DESCRIPTION OF THE PREFERRED EMBODIMENTS

Figure 1:
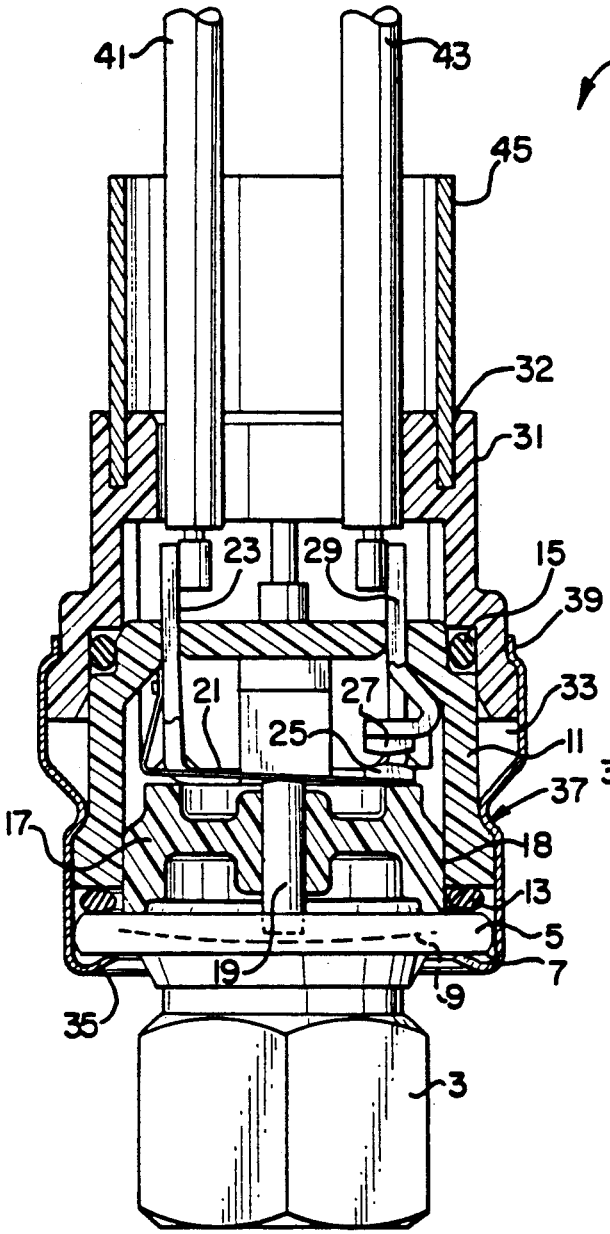
FIG. 1 is a cross sectional view of a pressure responsive switch in accordance with a first embodiment of the present invention.

Referring first to FIG. 1, there is shown a pressure responsive switch 1 in accordance with a first embodiment of the present invention. The switch 1 includes a pressure sensor portion including a hex nut 3 which is threaded at its hollow interior for engagement with a pressure source in standard manner. Also included as part of the pressure sensor portion is a chamber portion 5 with outwardly flanged walls 7 in which is disposed a pressure disc 9. The disc 9 is hermetically sealed to the chamber at its outer edges by welding around the outside diameter to provide isolation between the pressure source and the rest of the switch. The disc 9 is of the snap acting type which will snap from a convex downward position to a convex upward position when a predetermined pressure has been sensed. It should also be noted that the disc 9 could be temperature responsive, thereby providing a temperature responsive rather than a pressure responsive switch.

A base member 11 formed of PBT which is capable of withstanding temperatures of up to about 150 degrees C. rests on the pin guide 17 to be discusses hereinbelow. The base member 11 can be fabricated from thermoplastics, such as polyester or polyphenylene sulfide, as well as phenolic and other thermosetting materials. The base member 11 forms a first annular groove with the pin guide 17 and the chamber 5 for receiving therebetween a first O-ring 13. The base member 11 forms a second annular groove with the transition sleeve 31 (to be discussed hereinbelow) for receiving therebetween a second O-ring 15.

The pin guide 17 formed of PBT is disposed within the base member 11 and abuts the inner wall of the base member, the pin guide resting on the upper surface of the chamber 5 and having a central aperture for receiving therethrough a transfer pin 19 preferably formed of ceramic material though any suitable insulator can be used. The pin guide 17 has small protrusions 18 spaced therearound and is snapped into position by movement thereof into the base member with the protrusions providing a tight friction fit between the two elements. The pin 19 rests on the pressure disc 9 and moves along the axis of the aperture in the pin guide 17 to track movement of the disc.

The pin 19 normally rests below and out of contact with a first electrical conductor 21 formed of resilient spring material, preferably berrylium-copper, this conductor being secured at one end thereof to a first terminal 23 which is secured in the base member 11 and extends therethrough. The other end of the conductor 21 carries a first electrical contact 25 thereon. A second electrical contact 27 is disposed normally spaced from the contact 25 and is secured to an end of a second terminal 29, the other end of the second terminal being secured in the base member 11 and extending therethrough.

The transition sleeve 31 formed of electrically insulating material, preferably a thermoplastic polycarbonate having suitable mechanical, electrical, chemical and thermal properties, is disposed around the base member 11 and retains the O-ring 15 within the groove therefor in said base member. The transition sleeve 31, the base member 11 and the pressure sensor portion are secured together by a retainer cup 33 which has a flange portion 35 which is bent around and under the chamber 5, is crimped or rolled against an indentation 37 in the base member and is crimped into an indentation 39 in the transition sleeve. The transition sleeve 31 includes an annular groove at its upper portion for receiving a vinyl (PVC) tube section 45 which is adhesively secured therein, preferably with a cyanoacrylate adhesive. A pair of PVC insulation covered wires 41 and 43 are electrically coupled to the terminals 23 and 29 and extend through and out of the tube 45. The switch can be made waterproof by heating the tube 45 and insulation coated wires 41 and 43, causing the tube to coalesce with the wire insulation, forming a waterproof seal.

The switch of FIG. 1 is easily assembled by initially placing the terminal and contact assemblies 23, 25, 27 and 29 into the base 11 from the open end of the base and the pin guide 17 is then place thereover and snapped into place. This holds the terminal and contact assemblies in place by friction fit of the pin guide to the base. The O-ring 13 is then placed over the edge of the pin guide 17 and the transfer pin 19 is then dropped into the central aperture in the pin guide. The sensor including chamber 5, pressure disc 9 and hex nut 3 is then placed thereover against the O-ring 13 with the transfer pin 19 resting on the pressure disc. The retainer cup 33 is placed over the entire assembly and the cup 33 is crimped or rolled at 35 and 37 to hold this assembly together. This completes the assembly for the quick connect version.

The transition sleeve 31 and vinyl tube 45 are joined by adhesive in the groove 32 and the O-ring 15 is added to the inside diameter of the transition sleeve 31. This sleeve and tube assembly is slipped over the leads 41 and 43, the leads are attached by welding to the terminals 23 and 29 and the sleeve and tube assembly is pushed into the retainer cup 33. The cup 33 then is crimped at crimp 39. The vinyl to vinyl seal between the tube section 45 and the insulation on the wires 41 and 43 is formed electronically by using RF energy to heat the vinyl of both the tube section and the wire insulation as the vinyl is held together between cold jaws.

Figure 2:
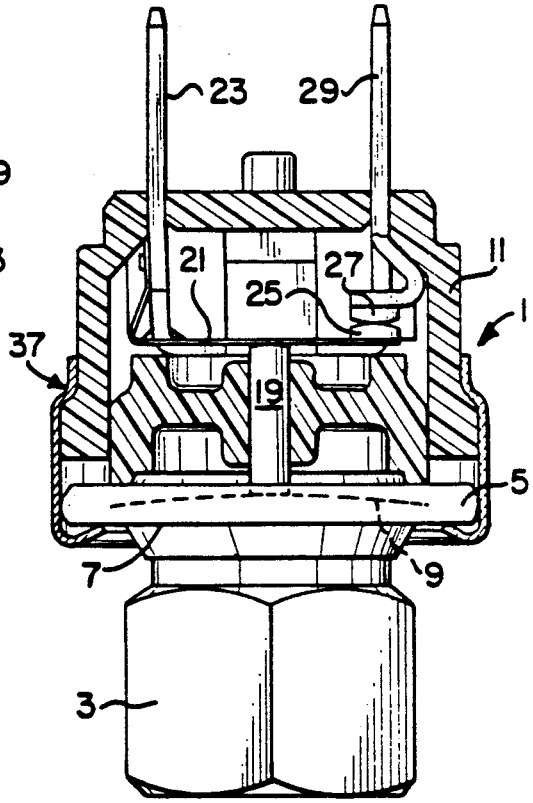
FIG. 2 is a cross sectional view of a quick connect version of the switch of FIG. 1.

In operation, the disc 9 is normally concave upward as shown in FIG. 1 and the pin 19 is normally out of contact with the resilient conductor 21. This permits the contacts 25 and 27 to be spaced from each other and provide an open circuit. When a pressure of predetermined degree is sensed by the disc 9, it snaps to a convex upward position as shown in FIG. 2 and forces the pin 19 upwardly against the resilient conductor 21. This causes the contact 25 to move upward along with the resilient conductor 21 and make contact with the contact 27, thereby closing the switch.

Referring now to FIG. 2, there is shown a quick-connect version of the embodiment of FIG. 1. This version is identical to that of FIG. 1 except for the omission of the transition sleeve 31, the O-rings 13 and 15 and the tube 45. The assembly and operation are as stated with regard to the embodiment of FIG. 1 except for the omitted elements not being assembled.

Figure 3:
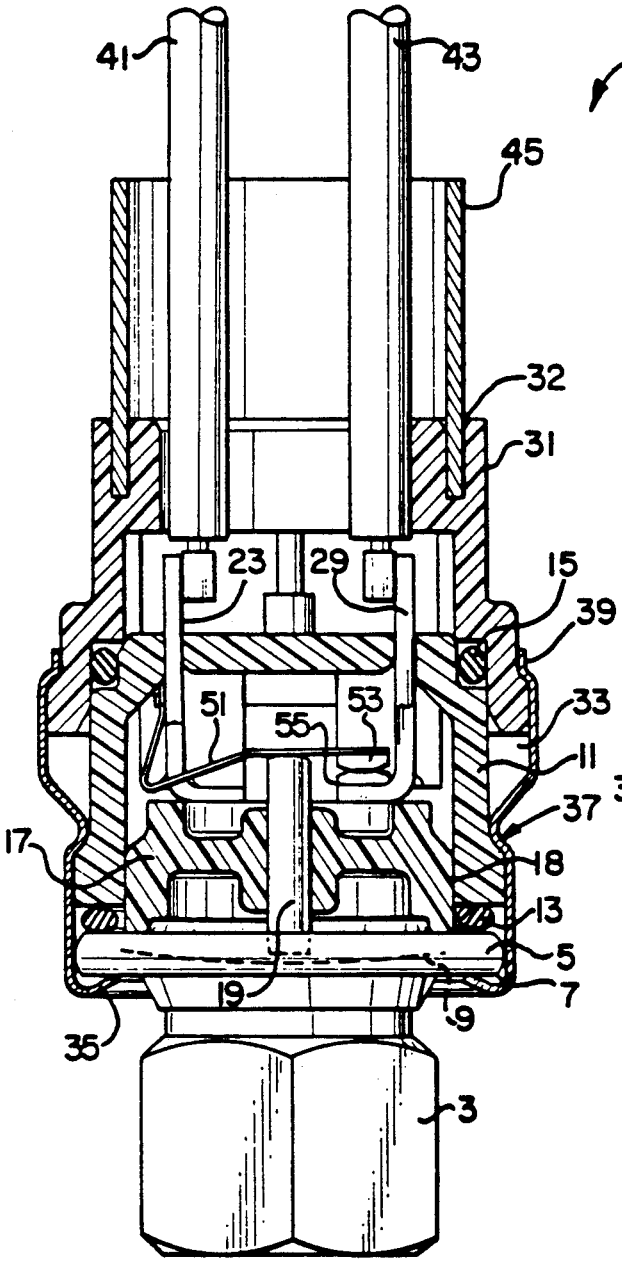
FIG. 3 is a cross sectional view of a pressure responsive switch in accordance with a second embodiment of the present invention.

Referring now to FIG. 3, there is shown a second embodiment of the present invention wherein elements similar or identical to those of the embodiment of FIG. 1 are provided with the same character reference.

The embodiment of FIG. 3 is identical to that of FIG. 1 except that the contacts 25 and 27 of FIG. 1 which are normally open are normally closed herein due to a minor change of structure. In this embodiment the pin 19 normally rests below and out of contact with a first electrical conductor 51 formed of resilient spring material, preferably berrylium-copper, this conductor being secured at one end thereof to the first terminal 23 which is secured in the base member 11 and extends therethrough. The other end of the conductor 51 carries a first electrical contact 53 thereon. A second electrical contact 55 is disposed normally in contact with the contact 53 and is secured to an end of the second terminal 29, the other end of the second terminal being secured in the base member 11 and extending therethrough.

Assembly of the embodiment of FIG. 3 is the same as that of FIG. 1.

In operation, when the disc 9 senses a pressure sufficient for it to snap from the concave upward to the convex upward position, the pin 19 will ride upwardly with the disc and force the conductor 51 to move upward, thereby moving the contact 53 upward and away from the spatially fixed contact 55 to open the switch.

Figure 4:
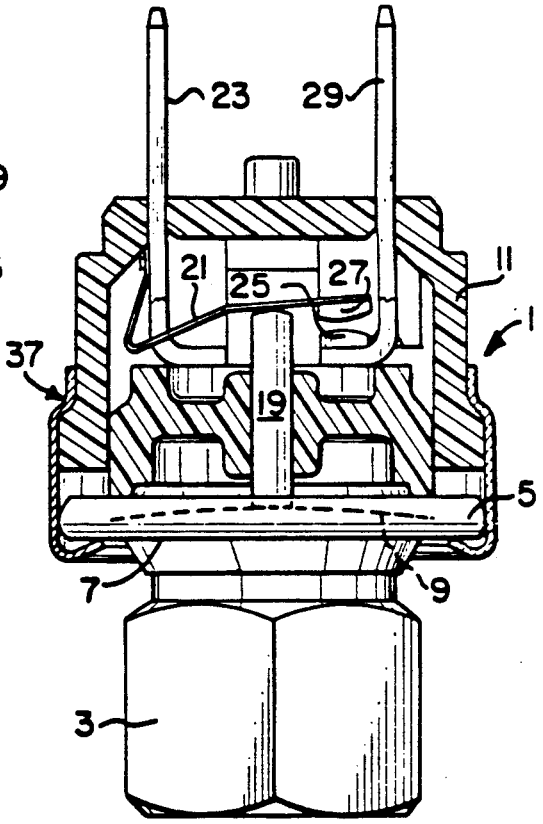
FIG. 4 is a cross sectional view of a quick connect version of the switch of FIG. 3.

Referring now to FIG. 4, there is shown a quick-connect version of the embodiment of FIG. 3. This version is identical to that of FIG. 3 except for the omission of the transition sleeve 31, the O-rings 13 and 15 and the tube 45. The assembly and operation are as stated with regard to the embodiment of FIG. 3 except for the omitted elements not being assembled.

Figure 5:
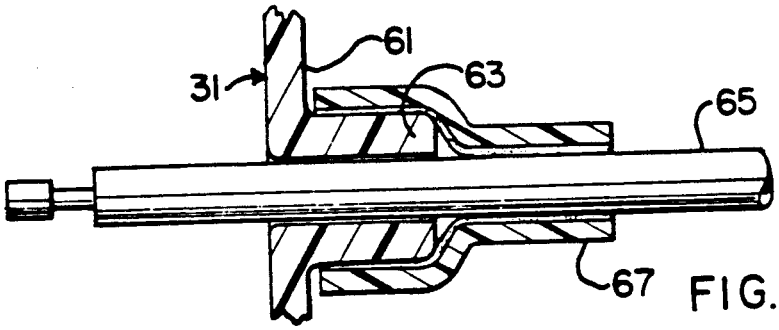
FIG. 5 is a cross sectional view of a first embodiment of a waterproof seal arrangement in accordance with the present invention.

Referring now to FIG. 5, there is shown a further embodiment of the present invention for providing waterproof sealing. In accordance with this embodiment, the transition sleeve 31 includes a top portion 61 having outwardly extending annular flange portions 63, one for each wire. The discussion herein will be with regard to one wire, it being understood that an identical arrangement would be provided for each additional wire. A wire 65 extends through the flange portion 63 and is secured within the switch in the manner discussed hereinabove. An adhesive lined heat shrinkable sleeve 67 is then placed over the flange portion 63 and the wire 65 and heated whereby the sleeve 67 shrinks over the wire and flange portion to provide the waterproof seal.

Figure 6:
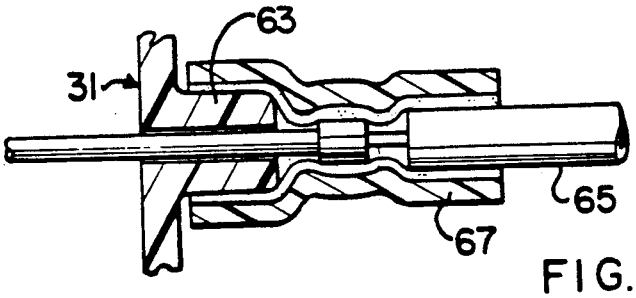
FIG. 6 is a cross sectional view of a second embodiment of a waterproof seal arrangement in accordance with the present invention.

Referring now to FIG. 6, there is shown an arrangement as in FIG. 5 except that the connection to the wire 65 is made external of the flange portion 63. In this embodiment, the shrinkable sleeve 67 is disposed over the flange portion 63, the wire 65 and the connection 69 and then heat shrunk to provide the desired waterproof seal.

Figure 7:
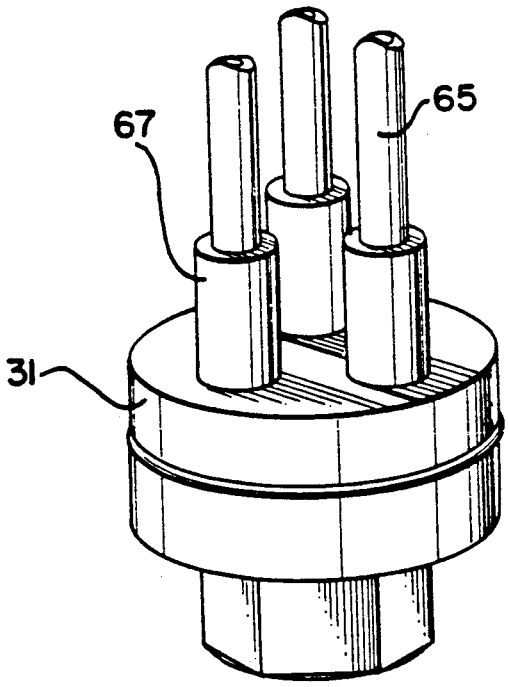
FIG. 7 is a perspective view of a switch assembly using the waterproof seal arrangement of FIG. 5 or 6.

FIG. 7 is a perspective view of a completed switch wherein the wires 65 have been sealed to the switch in accordance with the procedure of FIGS. 5 or 6.

It can be seen that there has been provided a low cost switch responsive to operation of a sensor wherein all elements are assembled and secured by friction fit and crimping and rolling of the retainer cup No riveting is required.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

I claim:

1. A condition responsive electrical switch comprising:

(a) a chamber having a condition responsive device disposed therein;

(b) a housing defining a switch cavity secured over and contacting said chamber, said housing comprising:

(c) a base member having a hollow interior disposed over and contacting said chamber;

(d) a fixed contact means and a movable contact means disposed within said base member;

(e) a pin guide disposed within said base member frictionally secured to said base member to hold said contact means in a selected place and to extend from the base member and contacting said chamber, an O-ring positioned around the pin guide between the chamber and base member, said pin guide including a centrally located aperture disposed over said condition responsive device;

(f) a transfer pin having one end thereof responsive to said condition responsive device and the other end thereof disposed adjacent, normally spaced from said movable contact means, and responsive to response of said condition responsive device to said condition to move said movable contact means; and (g) a cup engaging said chamber and said base member to compress the O-ring between the chamber and base member and to maintain said chamber and said base member in compressive engagement.

2. A condition-responsive electrical switch comprising:

(a) a chamber having a condition responsive device disposed therein;

(b) a housing defining a switch cavity secured over and contacting said chamber, said housing comprising:

(c) a base member having a hollow interior disposed over and contacting said chamber;

(d) a pin guide disposed within said base member frictionally secured to said base member and contact said chamber, said pin guide including a centrally located aperture disposed over said condition responsive device;

(e) a fixed contact and movable contact means disposed within said member;

(f) a transfer pin having one end thereof responsive to said condition responsive device and the other end thereof disposed adjacent, normally spaced from said movable contact means and responsive to response of said condition responsive device to said condition to move said movable contact means; and (g) a cup engaging said chamber and said base member to maintain said chamber and said base member in compressive engagement, the switch further including a transition sleeve secured to said base member, said sleeve defining a groove, and a polymer tube secured in said groove, said cup further engaging said sleeve to maintain said sleeve in compressive engagement with said base member.

3. A switch as set forth in claim 2 wherein said base member and said pin guide are formed of low thermal conductivity material capable of withstanding temperatures up to a first predetermined high temperature, said transition sleeve is formed of a low thermal conductivity material capable of withstanding temperatures up to a second predetermined temperature lower than said predetermined high temperature and said tube is formed of a low thermal conductivity material capable of withstanding temperatures up to a third predetermined temperature lower than second predetermined temperature.

4. A switch as set forth in claim 2 further including a pair of insulated wires, each of said wires connected to a different one of said fixed contact and movable contact means, said wires extending through said tube, the insulation of said wires being bondable to said tube.

5. A switch as set forth in claim 3 further including a pair of insulated wires, each of said wires connected to a different one of said fixed contact and movable contact means, said wires extending through said tube, the insulation of said wires being bondable to said tube.

6. A switch as set forth in claim 4 wherein said tube is formed of thermoplastic material and is secured to said insulation of said wires in water proof relation.

7. A switch as set forth in claim 5 wherein said tube is formed of thermoplastic material and is secured to said insulation of said wires in water proof relation.

8. A switch as set forth in claim 1, the contact means further including respective electrically conducting terminals secured in said base member, one of said terminals coupled to said fixed contact means and the other of said terminals coupled to said movable contact means.

9. A switch as set forth in claim 2, further including a pair of electrically conducting terminals secured in said base member, one of said terminals coupled to said fixed contact and the other of said terminals coupled to said movable contact means.

10. A switch as set forth in claim 7, further including a pair of electrically conducting terminals secured in said base member, one of said terminals coupled to said fixed contact and the other of said terminals coupled to said movable contact means.

11. A switch as set forth in claim 1 wherein said base member and said pin guide are formed of thermoplastic polyester.

12. A switch as set forth in claim 2 wherein said base member and said pin guide are formed of thermoplastic polyester, said transition sleeve is formed of a polycarbonate and said tube is formed of polyvinyl chloride.

13. A switch as set forth in claim 3 wherein said base member and said pin guide are formed of thermoplastic polyester, said transition sleeve is formed of a polycarbonate and said tube is formed of polyvinyl chloride.

14. A switch as set forth in claim 4 wherein said base member and said pin guide are formed of thermoplastic polyester, said transition sleeve is formed of a polycarbonate and said tube is formed of polyvinyl chloride.

15. A switch as set forth in claim 5 wherein said base member and said pin guide are formed of thermoplastic polyester, said transition sleeve is formed of a polycarbonate and said tube is formed of polyvinyl chloride.

16. A switch as set forth in claim 6 wherein said base member and said pin guide are formed of thermoplastic polyester, said transition sleeve is formed of a polycarbonate and said tube is formed of polyvinyl chloride.

17. A switch as set forth in claim 7 wherein said base member and said pin guide are formed of thermoplastic polyester, said transition sleeve is formed of a polycarbonate and said tube is formed of polyvinyl chloride.

18. A switch as set forth in claim 8 wherein said base member and said pin guide are formed of thermoplastic polyester.

19. A switch as set forth in claim 9 wherein said base member and said pin guide are formed of thermoplastic polyester, said transition sleeve is formed of a polycarbonate and said tube is formed of polyvinyl chloride.

20. A switch as set forth in claim 10 wherein said base member and said pin guide are formed of thermoplastic polyester, said transition sleeve is formed of a polycarbonate and said tube is formed of polyvinyl chloride.

21. A switch as set forth in claim 1 wherein said condition responsive device is a snap action disc having a movable portion, said transfer pin having said one end thereof disposed on said movable portion of said disc and responsive to movement of said movable portion and movable therewith.

22. A switch as set forth in claim 2 wherein said condition responsive device is a snap action disc having a movable portion, said transfer pin having said one end thereof disposed on said movable portion of said disc and responsive to movement of said movable portion and movable therewith.

23. A switch as set forth in claim 3 wherein said condition responsive device is a snap action disc having a movable portion, said transfer pin having said one end thereof disposed on said movable portion of said disc and responsive to movement of said movable portion and movable therewith.

24. A switch as set forth in claim 5 wherein said condition responsive device is a snap action disc having a movable portion, said transfer pin having said one end thereof disposed on said movable portion of said disc and responsive to movement of said movable portion and movable therewith.

25. A switch as set forth in claim 7 wherein said condition responsive device is a snap action disc having a movable portion, said transfer pin having said one end thereof disposed on said movable portion of said disc and responsive to movement of said movable portion and movable therewith.

26. A switch as set forth in claim 10 wherein said condition responsive device is a snap action disc having a movable portion, said transfer pin having said one end thereof disposed on said movable portion of said disc and responsive to movement of said movable portion and movable therewith.

27. A switch as set forth in claim 20 wherein said condition responsive device is a snap action disc having a movable portion, said transfer pin having said one end thereof disposed on said movable portion of said disc and responsive to movement of said movable portion and movable therewith.

28. A condition-responsive electrical switch comprising:

(a) a chamber having a condition responsive device disposed therein;

(b) a housing defining a switch cavity secured over and contacting said chamber, said housing comprising:

(c) a based member having a hollow interior disposed over and contacting said chamber;

(d) a pin guide disposed within said base member frictionally secured to said base member and contacting said chamber, said pin guide including a centrally located aperture disposed over said condition responsive device;

(e) a fixed contact and movable contact means disposed within said member;

(f) a transfer pin having one end thereof responsive to said condition responsive device and the other end thereof disposed adjacent, normally spaced from said movable contact means and responsive to response of said condition responsive device to said condition to move said movable contact means; and (g) a cup engaging said chamber and said base member to maintain said chamber and said base member in compressive engagement, the switch further including a transition sleeve secured to said base member, said sleeve including first and second hollow flange portions extending outwardly therefrom, a first wire having insulation thereon extending through said first hollow flange portion connected to said fixed contact, a second wire having insulation thereon extending through said second hollow flange portion connected to said movable contact means and heat shrinkable member disposed over said flange members and said insulation on said wire for providing waterproof seal therebetween.

29. A switch as set forth in claim 28 wherein said heat shrinkable member includes an adhesive on the interior thereof contacting said flange portion and said insulation.

30. A switch as set forth in claim 21 further including a transition sleeve secured to said base member, said sleeve including first and second hollow flange portions extending outwardly therefrom, a first wire having insulation thereon extending through said first hollow flange portion connected to said fixed contact, a second wire having insulation thereon extending through said second hollow flange portion connected to said movable contact means and heat shrinkable member disposed over said flange members and said insulation on said wires for providing waterproof seal therebetween.

31. A switch as set forth in claim 30 wherein said heat shrinkable member includes an adhesive on the interior thereof contacting said flange portion and said insulation.

* * * * *